US005815869A

United States Patent [19]

Hopkins

[11] Patent Number: 5,815,869

[45] Date of Patent: Oct. 6, 1998

[54] APPARATUS AND METHOD FOR CLEANING CARPETS AND FABRICS

[75] Inventor: John M. Hopkins, Orem, Utah

[73] Assignee: Venturi Technology Enterprises, Inc., Orem, Utah

[21] Appl. No.: 819,153

[22] Filed: Mar. 17, 1997

Related U.S. Application Data

[60] Provisional application No. 60/013,909 Mar. 18, 1996.

[51] Int. Cl. [6] ..... D06B 1/00

[52] U.S. Cl. ..... 8/158; 15/321; 134/10; 134/21; 134/34; 134/40

[58] Field of Search ..... 8/158; 15/321; 134/10, 21, 34, 40

[56] References Cited

U.S. PATENT DOCUMENTS

| | | | |
|---|---|---|---|
| 742,880 | 11/1903 | Lotz | 15/321 |
| 930,628 | 8/1909 | Squier | 15/321 |
| 2,292,435 | 8/1942 | Crites | 15/4 |
| 3,262,146 | 7/1966 | Hays | 15/321 |
| 3,654,662 | 4/1972 | Bates | 15/302 |
| 3,663,984 | 5/1972 | Anthony et al. | 15/321 |
| 3,747,155 | 7/1973 | Koellisch | 15/322 |
| 3,775,053 | 11/1973 | Wisdom | 8/142 |
| 3,883,301 | 5/1975 | Emrick et al. | 15/321 |
| 4,153,968 | 5/1979 | Perkins | 15/321 |
| 4,194,262 | 3/1980 | Finley et al. | 15/314 |
| 4,308,636 | 1/1982 | Davis | 15/321 |
| 4,327,459 | 5/1982 | Gilbert | 15/321 |
| 4,466,155 | 8/1984 | Grave | 15/331 |
| 4,488,330 | 12/1984 | Grave | 15/322 |
| 4,649,594 | 3/1987 | Grave | 15/322 |
| 4,654,925 | 4/1987 | Grave | 15/322 |
| 4,720,889 | 1/1988 | Grave | 15/322 |
| 5,134,748 | 8/1992 | Lynn | 15/321 |
| 5,493,754 | 2/1996 | Gurstein et al. | 15/321 |
| 5,555,597 | 9/1996 | Berfield | 15/321 |

FOREIGN PATENT DOCUMENTS 449826 3/1913 France .

*Primary Examiner*—Jeffrey Snay
*Assistant Examiner*—Sharidan Carrillo
*Attorney, Agent, or Firm*—James E. Bradley

[57] ABSTRACT

Electrolyzed oxidizing water, or EO water, flows from an EO water reservoir through a regulator and into a line for mixing with conventional tap water. The tap water passes through a strong, permanent magnet which aligns molecules within the water in order to reduce the plating of mineral deposits within the equipment. The combined EO water and tap water solution is supplied to a water pump has another permanent magnet. A water heater heats the solution which flows through a control valve to a carpet cleaning wand. The wand is connected to a vacuum hose for evacuating the solution as it is dispensed into the carpet. The waste water solution flows through the vacuum hose and into a waste water tank. A vacuum is drawn on the waste water tank by a conventional vacuum pump. The waste water solution is circulated in the waste water tank so that any sediment in the solution collects at the bottom of the tank.

18 Claims, 4 Drawing Sheets

APPARATUS AND METHOD FOR CLEANING CARPETS AND FABRICS

This is a continuation of provisional application Ser. No. 60/013,909, filed Mar. 18, 1996, now abandoned.

TECHNICAL FIELD

This invention relates in general to cleaning systems and in particular to a carpet cleaning system.

BACKGROUND ART

In general, carpet and upholstery cleaning devices direct a stream of water-based cleaning solution directly onto the material to be cleaned. Along with the driving force of the solution and concurrent vacuuming, the chemical properties of the solution significantly affect the ability of the cleaning device to remove dirt from the material.

Electrolyzed oxidizing water (herein after referred to as "EO water"), is a known product which comprises a strong acid solution. EO water is manufactured by commercially available equipment that electrolyzes tap water through an EO generator. EO water has been used for hospital purposes because it has advantages in preventing infection where chemical disinfectants have been previously used for this purpose. Although EO water has not been used in carpet cleaning solutions, it would facilitate the cleaning process.

DISCLOSURE OF INVENTION

Electrolyzed oxidizing water, or EO water, flows from an EO water reservoir through a regulator and into a line for mixing with conventional tap water. The tap water passes through a strong, permanent magnet which aligns molecules within the water in order to reduce the plating of mineral deposits within the equipment.

The combined EO water and tap water solution is supplied to a water pump has another permanent magnet. A water heater heats the solution which flows through a control valve to a carpet cleaning wand. The wand is connected to a vacuum hose for evacuating the solution as it is dispensed into the carpet. The waste water solution flows through the vacuum hose and into a waste water tank. A vacuum is drawn on the waste water tank by a conventional vacuum pump.

The waste water solution is circulated in the waste water tank so that any sediment in the solution collects at the bottom of the tank.

BEST MODE FOR CARRYING OUT THE INVENTION

Figure 1:
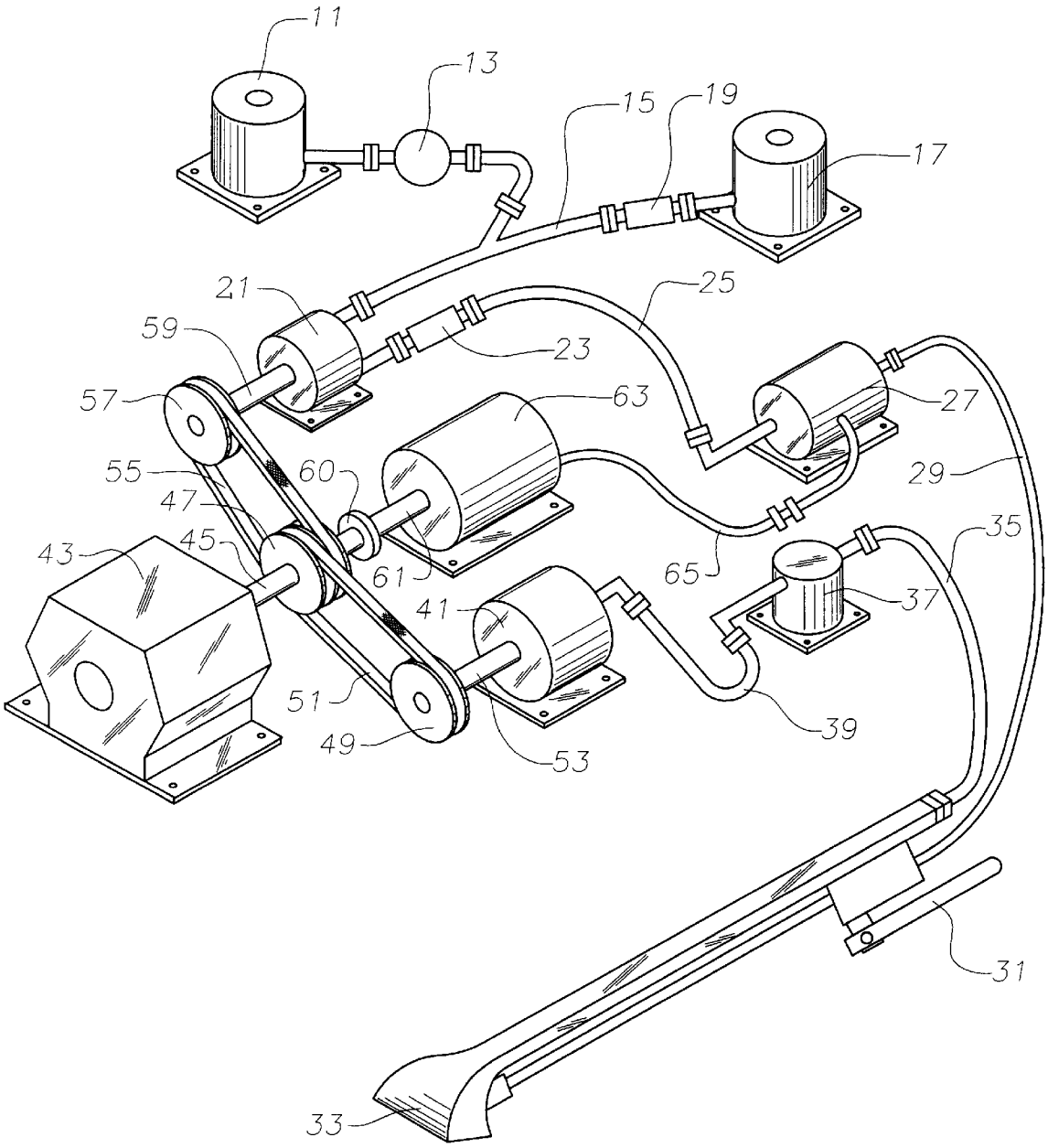
FIG. 1 is a perspective view illustrating a carpet cleaner constructed in accordance with this invention.

The equipment shown in FIG. 1 is a portable, commercial carpet cleaner which may be mounted on a truck. Referring to FIG. 1, the numeral 11 indicates a reservoir for holding electrolyzed oxidizing water (herein after referred to as "EO water"). EO water is a known product which comprises a strong acid solution with a pH of 2.6 or below, an oxidation-reduction potential of 1100 mV or more, an active chlorine of 8 to 10 ppm, and dissolved oxygen of 20.0 mg/l. This type of water is generated by commercially available equipment. One example of such equipment is Nippon Intek Company Limited, Model JAW-035. EO water is formed by electrolysis of tap water through an EO generator. "Tap water," as used in this specification, refers to water that is commonly available.

The EO water from EO reservoir 11 flows through a regulator 13 and into a line 15 for mixing with conventional tap water. Regulator 13 controls the amount of EO water flowing into line 15 at a preferred ratio in the range of 4 to 12 parts of tap water to 1 part of EO water. The tap water comes from a reservoir 17 and first passes through a plating module 19, which is a strong, permanent ceramic magnet. The magnet of plating module 19 is annular and aligns molecules within the solution that pass through it in order to reduce the plating of mineral deposits within the equipment.

The combined EO water and tap water solution is supplied to a water pump 21 which is connected to another plating module 23 with a line 25. Plating module 23 operates in the same manner as module 19 and passes the demineralized, high oxygen content water through line 25 to a water heater 27. Water heater 27 heats the solution to approximately 180 degrees Fahrenheit. The hot solution flows through line 29 and through a control valve 31 to a wand 33. Control valve 31 is of a manual type which allows the flow to be turned on and off by gripping or releasing a handle, respectively.

Wand 33 is connected to a vacuum hose 35 for evacuating the solution as it is dispensed into the carpet. The waste water solution flows through vacuum hose 35 and into a waste water tank 37. A vacuum is drawn on waste water tank 37 through a line 39. Line 39 is connected to a conventional vacuum pump 41 which draws a relatively high vacuum. The amount of vacuum should be from 9 to 16 inches of mercury.

The power means for operating the various components includes a power source 43. In a truck mounted unit, all of the components except high pressure line 29, wand 33, and hose 35 will remain on the truck. In this instance, the power source 43 will be an engine. Power source 43 drives a shaft 45, which in turn rotates pulleys 47 and 49 via belt 51. Pulley 49 is mounted to a shaft 53 which drives vacuum pump 41. Shaft 45 and pulley 47 also drive a pulley 57 via belt 55. Pulley 57 is mounted to a shaft 59 for driving water pump 21. Shaft 45 is also connected through a coupling 60 to a shaft 61. Shaft 61 drives a generator 63 which supplies electrical power through a power cable 65 for operating heater 27. For carpet cleaners in which all of the components may be removed entirely from a vehicle, electrical power from a building or dwelling may be employed as power source 43. In this configuration alternator 63 may not be required.

Figure 2:
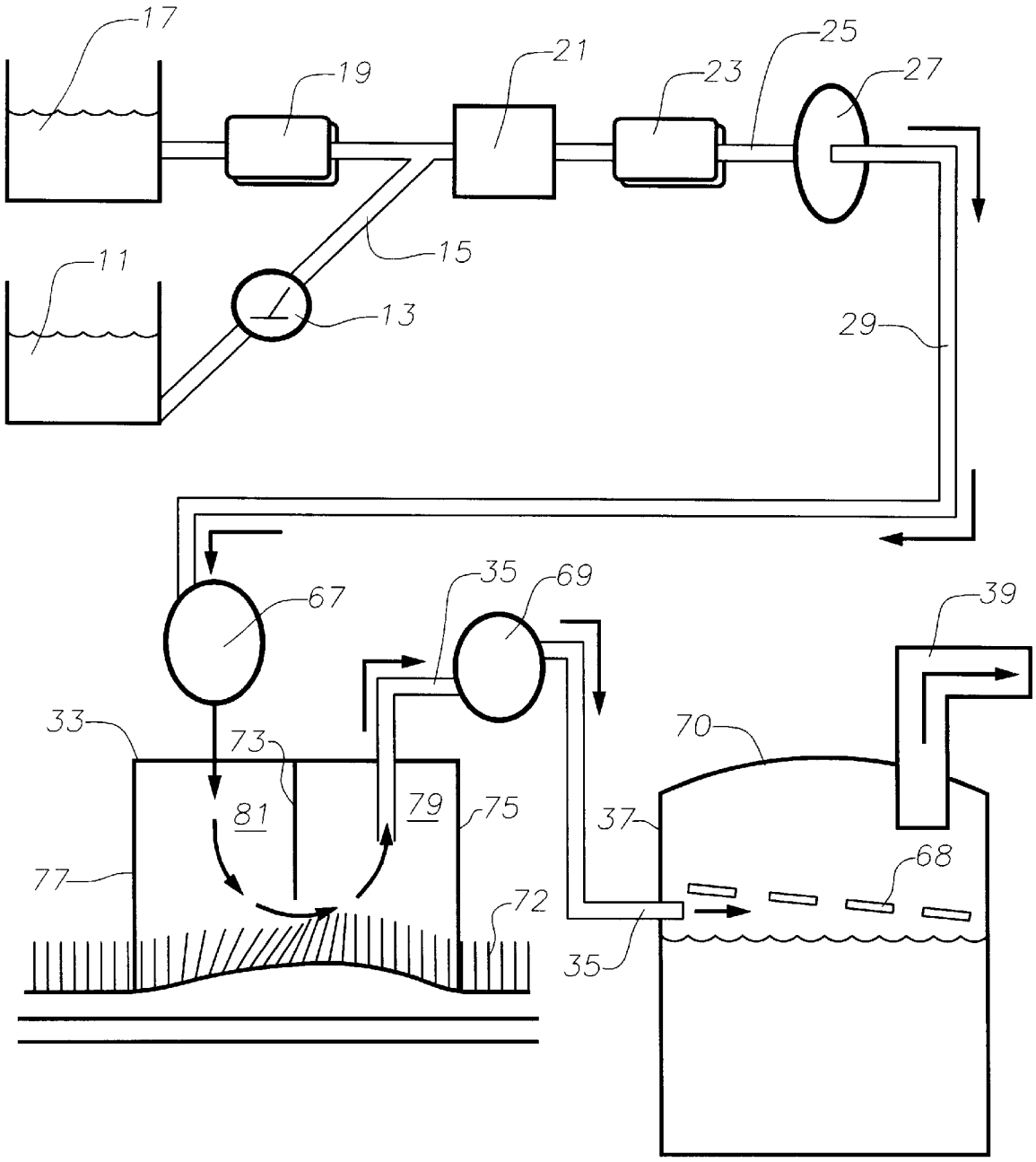
FIG. 2 is a schematic view illustrating the operation of the carpet cleaner of FIG. 1.

Referring to FIG. 2, the carpet cleaner includes a line reel 67 for coiling line 29 and a hose reel 69 for coiling hose 35. Hose 35 and the waste water solution enters the side of waste water tank 37 tangentially. Waste water tank 37 contains a plurality of substantially horizontal vanes 68 along an inner surface. Vanes 68 form a semi-circular band and begin near hose 35 for directing the waste water solution around tank 37. The waste water solution being drawn into tank 37 is circulated so that any sediment in the solution collects at the bottom of tank 37. Air is circulated in the upper portion of tank 37 and is drawn out of tank 37 by line 39. The inlet to line 39 is located in the dome-like top 70 of tank 37. FIG. 2 illustrates the operation previously described and further shows the carpet 72 being acted upon by wand 33. The high oxygen content of the EO water aids in the cleaning and scrubbing of carpet 72.

Figure 3:
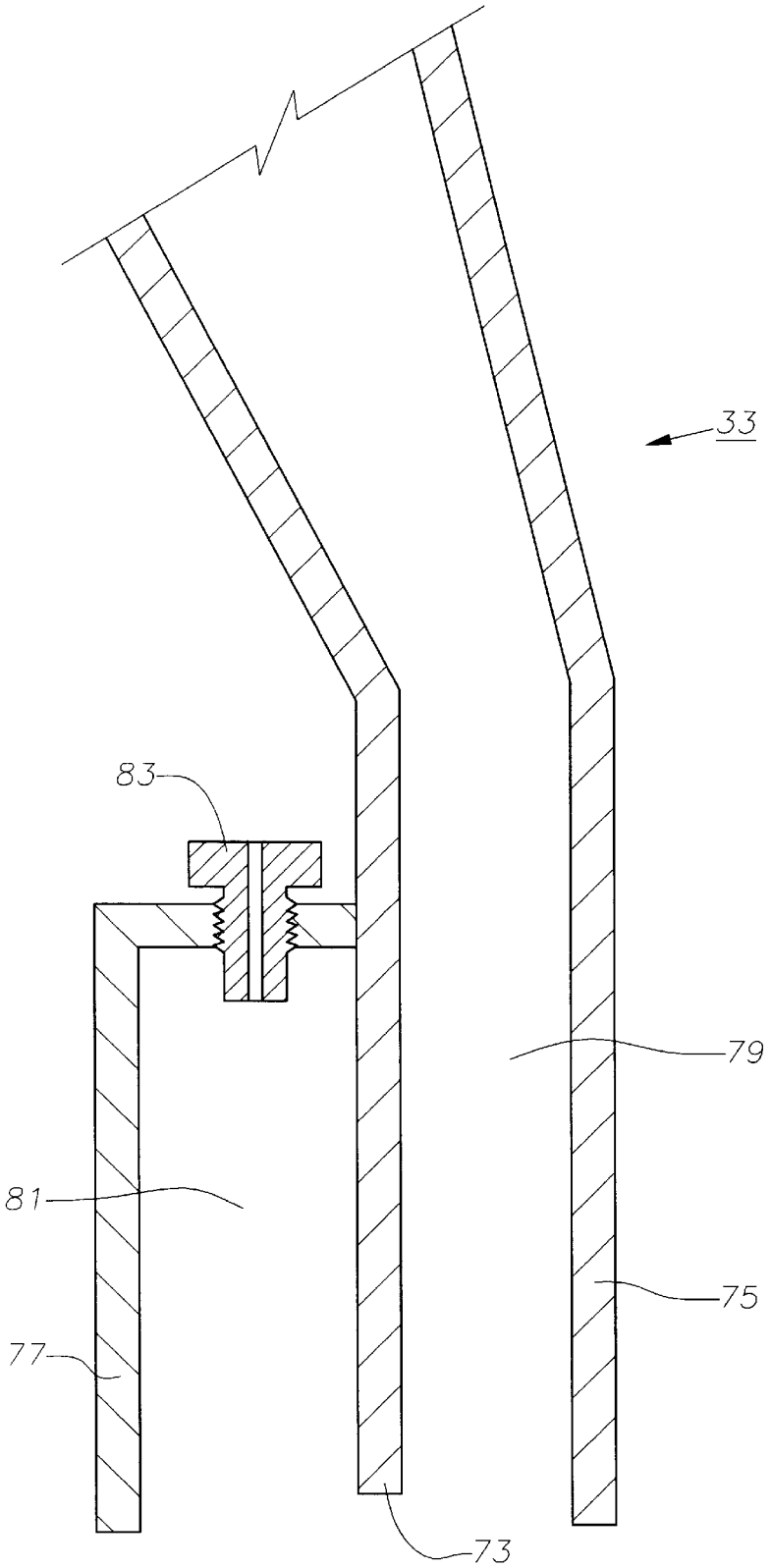
FIG. 3 is a side sectional view of the wand of the carpet cleaner of FIG. 1.

Referring to FIG. 3, wand 33 has a central partition 73 parallel to and spaced halfway between a trailing wall 75 and a leading wall 77. Leading wall 77 is the wall that first contacts carpet 72 as wand 33 is pulled. Trailing wall 75 and partition 73 define a vacuum chamber 79. Hose 35 (FIG. 1) is connected to vacuum chamber 79. Partition 73 and leading wall 77 define an injection chamber 81. Spray jets 83 are connected to line 29 (FIG. 1) and spray the EO and tap water solution down injection chamber 81. Note that partition 73 has a lower edge which terminates a short distance above the lower edges of trailing and leading walls 75, 77. This allows the continuous flow of EO and tap water solution from the injection chamber 81, through carpet 72 and out the vacuum chamber 79, as illustrated in FIG. 2.

Figure 4:
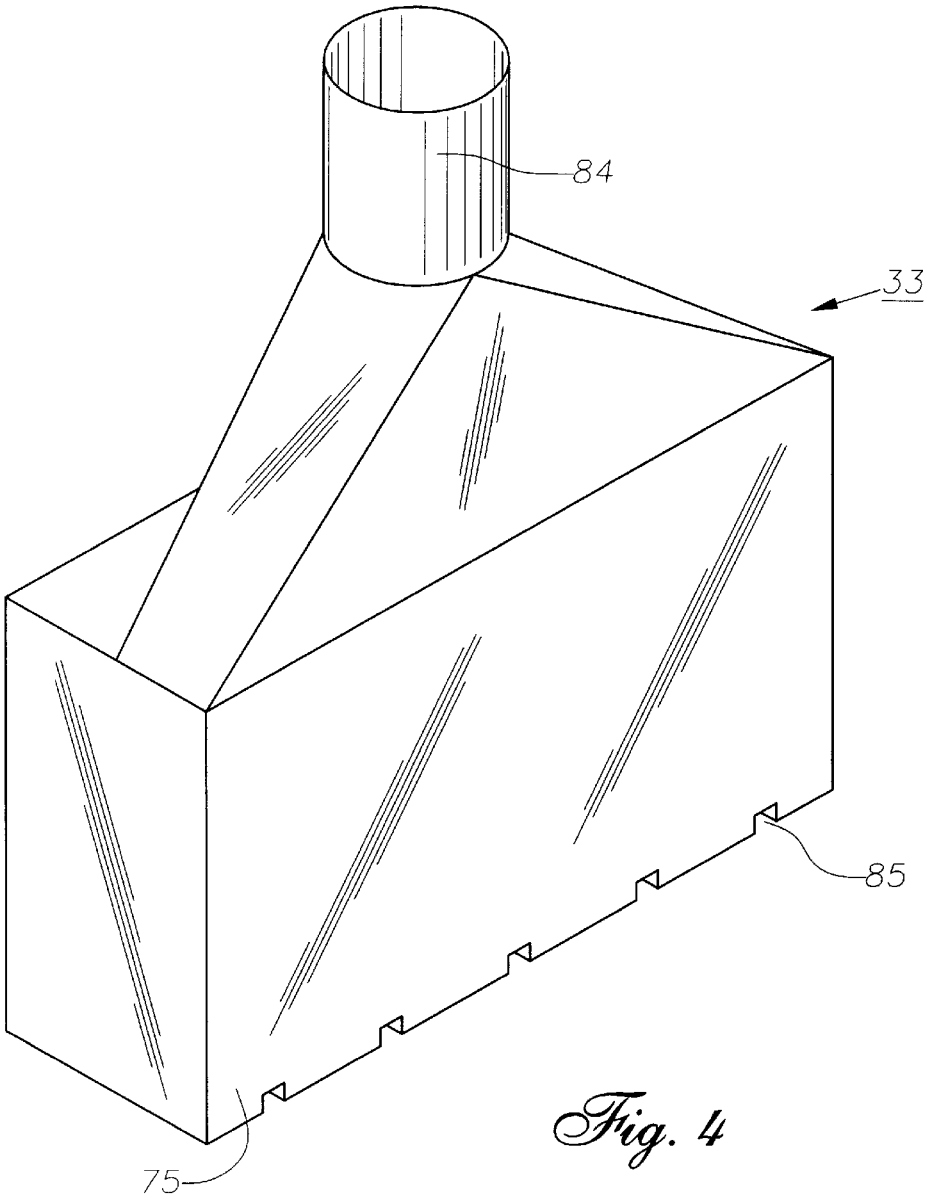
FIG. 4 is a perspective view of the wand of FIG. 3.
Figure 5:
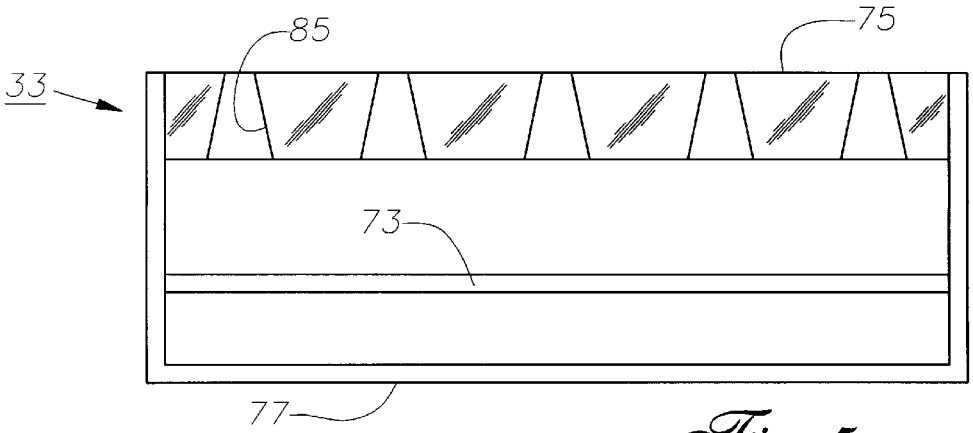
FIG. 5 is a bottom plan view of the wand of FIG. 3.

Referring to FIGS. 4 and 5, a plurality of slots 85 are located along the lower edge of trailing wall 75. Slots 85 allow the admission of air to vacuum chamber 79 due to the high vacuum being drawn. The air flowing through the slots 85 creates vortices which enhance scrubbing of the carpet. In the preferred embodiment, there are a plurality of slots 85 spaced along the length of the lower edge of trailing wall 75. There are no slots formed on the lower end of partition 73 nor leading wall 77. Slots 85 converge from trailing wall 75 into vacuum chamber 79. This tapering enhances the formation of vortices. FIG. 4 also shows a cylindrical hose end 84 on the upper end of wand 33 for connecting to hose 35 (FIG. 1).

The invention has advantages. By using EO water in the solution, this carpet cleaning system offers superior carpet, rug and upholstery cleaning ability.

While the invention has been shown in only one of its forms, it should be apparent to those skilled in the art that it is not so limited, but is susceptible to various changes without departing from the scope of the invention.

I claim:

1. A cleaning system for cleaning fabrics and carpets comprising:

a) a water reservoir having a volume of tap water contained therein;

b) an electrolyzed oxidizing water reservoir having a volume of electrolyzed oxidizing water contained therein;

c) a water reservoir outlet line connected to said water reservoir for transporting said tap water from said water reservoir;

d) an electrolyzed oxidizing water outlet line communicating with said electrolyzed oxidizing water reservoir and said water reservoir outlet line for mixing an amount of said electrolyzed oxidizing water with said tap water at a predetermined ratio to produce a cleaning solution;

e) a regulator located in said electrolyzed oxidizing water outlet line for regulating said amount of said electrolyzed oxidizing water to said electrolyzed oxidizing water outlet line from said electrolyzed oxidizing water reservoir;

f) a cleaning wand communicating with said electrolyzed oxidizing water outlet line for applying said cleaning solution to a carpet or a fabric;

g) a waste water tank communicating with said cleaning wand for collecting said cleaning solution from said carpet or said fabric; and h) a vacuum pump which communicates with said waste water tank for collecting said cleaning solution from said carpet or said fabric through said cleaning wand and into said waste water tank.

2. The cleaning system of claim 1, further comprising a water pump communicating with said electrolyzed oxidizing water outlet line and located upstream from said cleaning wand for pumping said cleaning solution to said cleaning wand.

3. The cleaning system of claim 2, further comprising a water heater located between said water pump and said cleaning wand for heating said cleaning solution before it is applied to said fabric or said carpet.

4. The cleaning system of claim 1, further comprising a permanent ceramic magnet located in said water reservoir outlet line for substantially removing mineral deposits from said tap water.

5. The cleaning system of claim 1, wherein said regulator controls said amount of electrolyzed oxidizing water flowing to said electrolyzed oxidizing water outlet line at said predetermined ratio of 1 part electrolyzed oxidizing water to 4 to 12 parts tap water.

6. The cleaning system of claim 1 wherein the electrolyzed oxidizing water comprises a strong acid solution with a pH of 2.6 or below, an oxidation-reduction potential of 1100 mV or more, an active chlorine of 8 to 10 ppm, and dissolved oxygen of 20.0 mg/l.

7. A cleaning system for cleaning fabrics and carpets comprising:

a) a water reservoir having a volume of tap water contained therein;

b) an electrolyzed oxidizing water reservoir having a volume of electrolyzed oxidizing water contained therein;

c) a water reservoir outlet line connected to said water reservoir for transporting said tap water from said water reservoir;

d) an electrolyzed oxidizing water outlet line communicating with said electrolyzed oxidizing water reservoir and said water reservoir outlet line for mixing an amount of said electrolyzed oxidizing water with said tap water at a predetermined ratio to produce a cleaning solution;

e) a regulator located in said electrolyzed oxidizing water outlet line for regulating said amount of said electrolyzed oxidizing water to said electrolyzed oxidizing water outlet line from said electrolyzed oxidizing water reservoir;

f) a cleaning wand communicating with said electrolyzed oxidizing water outlet line for applying said cleaning solution to a carpet or a fabric;

g) a water pump communicating with said electrolyzed oxidizing water outlet line and located upstream from said cleaning wand for pumping said cleaning solution from said electrolyzed oxidizing water outlet line to said cleaning wand;

h) a water heater located in series between said water pump and said cleaning wand for heating said cleaning solution before it is applied to said carpet or said fabric;

I) a waste water tank having a vacuum hose which communicates with said cleaning wand for collecting said cleaning solution from said carpet or said fabric; and j) a vacuum pump which communicates with said waste water tank for collecting said cleaning solution from said carpet or said fabric through said cleaning wand and into said waste water tank.

8. The cleaning system of claim 7, further comprising a first permanent ceramic magnet located in said water reservoir outlet line for substantially removing mineral deposits from said tap water.

9. The cleaning system of claim 8, wherein said first permanent ceramic magnet is located between said water reservoir and said electrolyzed oxidizing water outlet line.

10. The cleaning system of claim 7, further comprising a second permanent ceramic magnet located between said water pump and said water heater for substantially removing mineral deposits from said cleaning solution.

11. The cleaning system of claim 7, further comprising a first permanent ceramic magnet located in said water reservoir outlet line for substantially removing mineral deposits from said tap water and a second permanent ceramic magnet located between said water pump and said water heater for substantially removing mineral deposits from said cleaning solution.

12. The cleaning system of claim 7, wherein said regulator controls said amount of electrolyzed oxidizing water flowing to said electrolyzed oxidizing water outlet line at said predetermined ratio of 1 part electrolyzed oxidizing water to 4 to 12 parts of tap water.

13. The cleaning system of claim 7 wherein the electrolyzed oxidizing water comprises a strong acid solution with a pH of 2.6 or below, an oxidation-reduction potential of 1100 mV or more, an active chlorine of 8 to 10 ppm, and dissolved oxygen of 20.0 mg/l.

14. A method for cleaning fabrics and carpets comprising:

a) providing a first electrolyzed oxidizing water reservoir having a volume of electrolyzed oxidizing water contained therein;

b) providing a source of tap water;

c) mixing a solution of said electrolyzed oxidizing water with said tap water at a predetermined ratio to produce a cleaning solution;

d) applying said cleaning solution to a carpet or a fabric with a cleaning wand;

e) applying a vacuum to said carpet or said fabric with a vacuum source; and f) collecting said cleaning solution from said carpet or said fabric through said cleaning wand with said vacuum source.

15. The method of claim 14, further comprising a step of pumping said cleaning solution to said cleaning wand with a water pump.

16. The method of claim 14, further comprising a step of heating the solution with a water heater before it is applied to said carpet or said fabric.

17. The method of claim 14, further comprising a step of removing mineral deposits from said cleaning solution before said cleaning solution is applied to said carpet or said fabric.

18. The method of claim 14, wherein said predetermined ratio comprises 1 part electrolyzed oxidizing water to 4 to 12 parts of tap water.

* * * * *